US006699325B2

(12) United States Patent
Mauchle et al.

(10) Patent No.: US 6,699,325 B2
(45) Date of Patent: Mar. 2, 2004

(54) POWDER FACILITY FOR SPRAY-COATING PURPOSES

(75) Inventors: Felix Mauchle, Abtwil (CH); Markus Lenherr, Arnegg (CH)

(73) Assignee: ITW Gema AG, St. Gallen (CH)

( * ) Notice: Subject to any disclaimer, the term of this patent is extended or adjusted under 35 U.S.C. 154(b) by 69 days.

(21) Appl. No.: 10/042,353

(22) Filed: Jan. 11, 2002

(65) Prior Publication Data

US 2002/0092468 A1 Jul. 18, 2002

(30) Foreign Application Priority Data

Jan. 13, 2001 (DE) ..... 101 01 366

(51) Int. Cl.[7] ..... B05C 19/00; B05C 15/00

(52) U.S. Cl. ..... 118/309; 118/308; 118/302; 134/102.2; 134/167 C

(58) Field of Search ..... 118/308, 309, 118/302; 406/28, 122, 124, 141–143, 98, 12, 120; 134/102.2, 167 C

(56) References Cited

U.S. PATENT DOCUMENTS 5,271,695 A * 12/1993 Bischof et al. ..... 406/114
5,846,031 A * 12/1998 Rutz ..... 406/142
5,928,423 A 7/1999 Toyota et al.
6,056,483 A * 5/2000 Nakamura et al. ..... 406/134
6,176,647 B1 * 1/2001 Itoh ..... 406/31

FOREIGN PATENT DOCUMENTS

| | | |
|---|---|---|
| DE | 40 21 674 A1 | 1/1992 |
| DE | 29518478 | 2/1996 |
| DE | 19517229 | 11/1996 |
| DE | 19823068 | 11/1999 |
| EP | 0 689 875 A2 | 1/1996 |
| WO | WO 94/21554 | 9/1994 |
| WO | WO 01/19529 | 3/2001 |

* cited by examiner

*Primary Examiner*—Richard Crispino
*Assistant Examiner*—Yewebdar T Tadesee
(74) *Attorney, Agent, or Firm*—Lowe Hauptman Gilman & Berner LLP

(57) ABSTRACT

A powder facility used for spray coating includes at least one injection unit (6), at least two powder stations (2) and at least one cleaning unit (16) which are mutually displaceably in program-controlled manner in order to alternatively convey powder from one of the powder receptacles of the powder stations or to clean the powder-flow itineraries using compressed cleaning air.

20 Claims, 3 Drawing Sheets

POWDER FACILITY FOR SPRAY-COATING PURPOSES

TECHNICAL FIELD

The present invention relates to a spray-coating powder facility.

Accordingly the invention relates to a spray-coating powder facility containing at least two powder stations per powder receptacle, at least one injection unit comprising at least one injector fitted with a powder pickup pipe which can be dipped into a powder container of the powder stations in order to aspirate from it powder to be conveyed to a receiver.

BACKGROUND ART

A spray-coating powder facility of this kind is known from EP 0 689 875 A2. It discloses an air injection unit fitted with several powder pickup pipes comprising an injector at their lower end. The injector unit is supported by a conveying system which may be in the form of a system with which to dip the powder pickup pipes into a powder receptacle, or of a robot fitted with a robot arm moving the injection unit into arbitrary (3D) directions.

However instead of configuring an injector at the lower end of a powder pickup pipe, it is more common practice to mount the injector at the upper end of the powder pickup pipe, for instance in the manner disclosed in DE 40 21 674 A1.

It is further practically known to configure the powder receptacles and their injection unit into an evacuation cabin from which air is aspirated by means of a blower and filter assembly. In this manner a slight partial vacuum is maintained in the evacuation cabin to prevent powder particles from leaking out of the evacuation cabin.

When changing pigments or powder (changing from one pigment to another), it is necessary not only to exchange the powder receptacles but furthermore all powder itineraries from the powder receptacle to the spray system also must be cleaned or exchanged. Cleaning is implemented using compressed air to blow clean the external surfaces of the powder itineraries and/or using compressed air which is blown through the inner paths, ordinarily through manually held compressed-air hoses.

SUMMARY OF THE INVENTION

The objective of the invention is to accelerate powder changing and to reduce the labor entailed in changing powders.

In the invention, the powder facility for spray coating is characterized in that it comprises at least one cleaning unit fitted with at least one compressed-air output matching an intake aperture at the lower pipe end of the powder pickup pipe in order to blow compressed cleaning air through the powder pickup tube and its injector and thus to clean them, further in that the minimum of one injection unit is displaceable in controlled manner relative to the powder stations and relative to the minimum of one cleaning unit in order to operationally connect the minimum of one injection unit alternatively to one of the powder stations or to the minimum of one cleaning unit, the minimum of one injection unit being controlled to alternatively dip by means of at least one powder pickup pipe into a receptacle of the powder stations for the purpose of conveying coating powder therefrom or in that said minimum of one injection unit being controlled to combine outside the receptacles with the cleaning unit for the purpose blowing compressed cleaning air through the minimum of one powder pickup pipe and its injector.

Accordingly the spray-coating powder facility may be designed in such a way that the powder stations and at least one cleaning unit shall be mutually fixed in place and in that the minimum of one injection unit shall be controlled to be displaceable in at least two and preferably three dimensions. This design offers the advantage that no drive system is needed for the heavy powder stations and that only stationary compressed air lines are needed for the cleaning unit.

Preferably the powder stations are arrayed in a straight or a circular line. This configuration simplifies the relative motions between the injection unit and the powder stations.

The minimum of one cleaning unit may be situated next to the line of powder stations. As a result, the displacement paths of the injection unit can be kept short. In another embodiment, one cleaning unit may be configured between every two or more powder stations. The displacement paths are shortened even more thereby.

In an especial embodiment, the powder stations can be controlled to move along a horizontal dimension of motion, namely the minimum of one injection unit being moved in controlled manner in a vertical dimension of motion, and the minimum of one cleaning unit shall be fixed in place within the dimension of motion of the powder stations. As a result the danger of supply line leaks shall be reduced because the pneumatic lines of the cleaning unit shall not be displaced and the injection unit need not be rotated at its pneumatic and powder lines.

The powder stations may be configured in a straight or circular line on a horizontally displaceable stage, where said line runs along the horizontal dimension of motion. In this manner the equipment of the invention may be matched to the spatial conditions at the site of application.

In a preferred embodiment the stage assumes the form of a turntable of which the center of rotation is situated at the center of the circular line of powder stations. Such a configuration is compact and its injection unit in it need not be rotatable.

In an especially preferred embodiment, the invention provides that the minimum of one cleaning unit shall be mounted underneath the stage on a base that is fixed relative to the stage and in that the stage shall comprise at least one vertical passage through which the minimum of one injection unit and the cleaning unit can be vertically joined to each other to be cleaned by the compressed cleaning air. This feature allows reducing the number of cleaning units, for instance to just one; this configuration is very compact; and the compressed air lines and the powder lines need not follow relative motions between the facility components. The cleaning unit may be vertically displaceable.

All embodiments preferably comprise a cleaning system for external surfaces fitted with at least one compressed-air nozzle by means of which compressed air can be blown on the external surfaces of parts of the injection unit, at least on the external surfaces of the powder pickup pipes, when the injection unit is situated opposite the cleaning unit. As a result, the coating powder is prevented from dropping from these external surfaces into a powder receptacle and from contaminating the coating powder in said receptacle.

Preferably the itinerary of the compressed cleaning air blown into the compressed-air cleaning pipe will run beyond the powder pickup pipe and its injector as far as the receiver. In this manner the powder line, usually a hose, need not be separately cleaned or exchanged when changing powders.

Powders can be changed in especially rapid manner and entailing little or no labor if, in the manner of the invention, an electronic control system is used that contains at least one computer program controlling the relative motions of the minimum of one injection unit, the powder stations and the minimum of one cleaning unit, further controlling powder conveyance, powder changes and cleaning using the compressed cleaning air. Preferably the control system shall be freely programmable as regards the computer program in order to allow speedily matching customer requirements.

At least the powder stations and the cleaning unit, but preferably also the injection unit and the moving systems for these stations and/or units shall preferably be mounted within an evacuation cabin fitted with a filter and blower system filtering and evacuating air out of the evacuation cabin into the environment. Coating powder is prevented thereby to reach the outside environment.

The filter and blower system sucks the air and powder inside the evacuation cabin preferably transversely to and through the powder stations arrayed in a line in order that no powder shall be transferred from powder station to powder station whereby otherwise different powders might be mixed.

The invention implements the following design:

(a) Preferably situated within an evacuation cabin, the powder facility comprises at least two powder stations resp. powder receptacles, at least one injection unit, at least one cleaning unit cleaning the injection unit using compressed air, a drive system to relatively move the injection unit, the powder receptacles and the cleaning unit, and an electronic control system controlling said motions and the operations of said parts, preferably as a function of one or more computer programs. The evacuation cabin contains one or more blower units with associated filters. These blower units generate a partial vacuum of such magnitude in the evacuation cabin that no powder or air may leak out said cabin into the external environment. Preferably the air inside the evacuation cabin is guided in such a way that the flow of air and powder in said cabin runs from the individual powder receptacles to the filters without thereby moving over other powder receptacles and consequently in a way to preclude contaminating powder pigments among the powder receptacles. Preferably the powder receptacles shall be separated by partitions.

(b) The injection unit may contain one or several injectors and can be displaced in controlled manner relative to the powder receptacles (powder stations) and to the cleaning unit. This operation can be implemented in several ways: the injection unit may be displaceable whereas the other components may be stationary; or the injection unit is stationary and the other two components are displaceable; or the powder receptacles (powder stations) are stationary and the injection unit and the cleaning unit are displaceable; or all three components are displaceable. A drive unit is provided for such purposes and is able to move the injection unit (or one and/or the other component "powder stations and/or cleaning unit") in two or more dimensions on several planes and at different speeds. The drive elements used for said drive unit may be elements of the state of the art, preferably electric and/or pneumatic drive elements.

(c) Preferably the cleaning unit shall be situated near the injection unit and may be in the form of one unit or several. This cleaning unit blows clean the injectors and their powder pickup pipes on the inside and preferably also on the outside. Moreover wiper pins or similar cleaning accessories may be used to clean the external surfaces of the injection unit.

(d) Preferable the powder receptacles shall be stationary and preferably they shall be controlled using fluidizing, vibrating, sifting, leveling and/or weighing units. The terminology used in the present patent that the powder receptacles, the injection unit and the cleaning unit are mutually displaceable, that is, that they are mounted in "movable" or "fixed" manner, merely denotes mutual positioning displacements, but not vibrations or other motions leaving the relative positions of these parts unaffected. On that account a "fixed" powder station nevertheless may be fitted with a vibration unit to vibrate its power receptacle.

According to the invention, when there is a change from one powder receptacle to another, the injection unit may be automatically moved to the cleaning unit and be automatically cleaned at latter before proceeding to the other powder receptacle. The injection unit is dipped by its powder pickup pipes into the pertinent powder receptacle in order to pneumatically remove pigment from it and convey it to a spray system or a buffer container on the way to said system.

BRIEF DESCRIPTION OF THE DRAWINGS

The invention is elucidated below in relation to the drawings and by means of preferred illustrative embodiments.

DETAILED DESCRIPTION OF THE INVENTION

Figure 1:
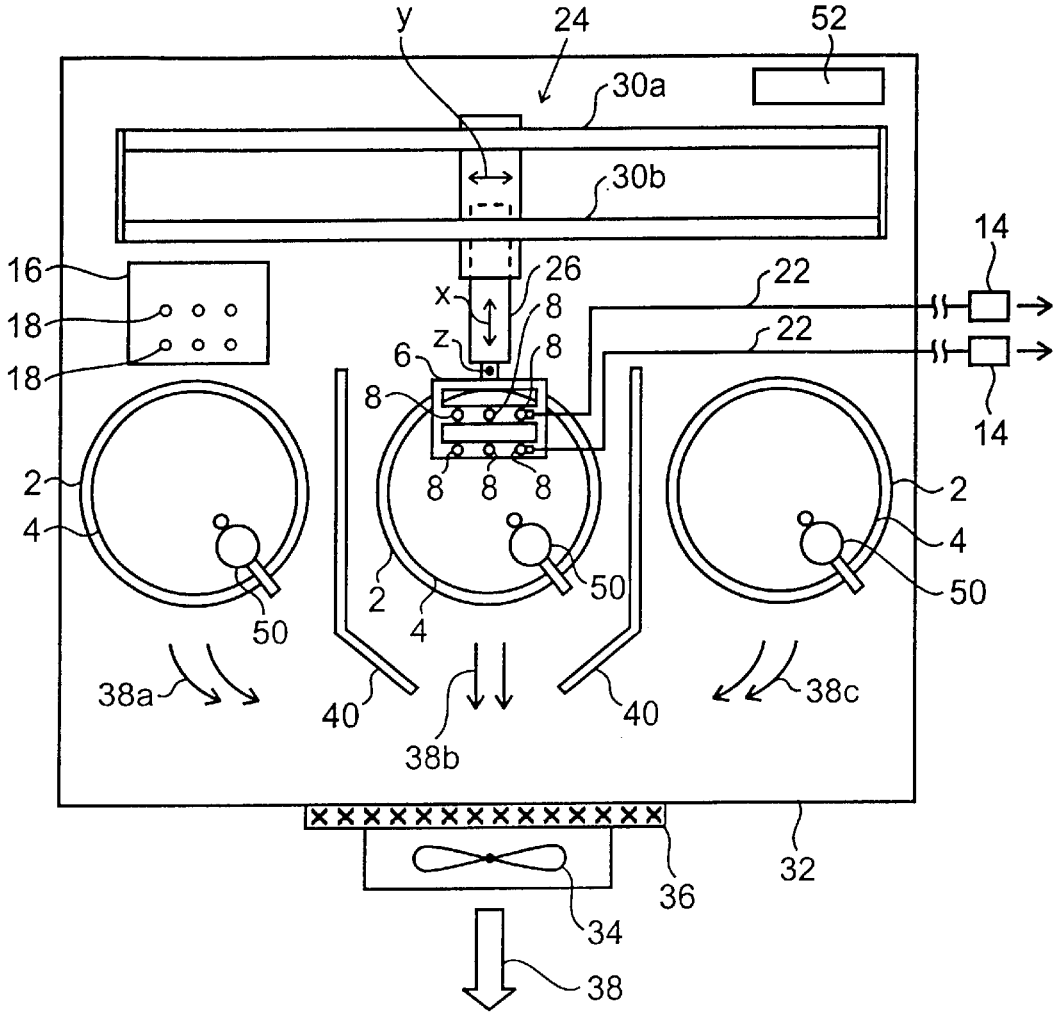
FIG. 1 is a schematic topview of a powder facility for spray coating of the invention.
Figure 2:
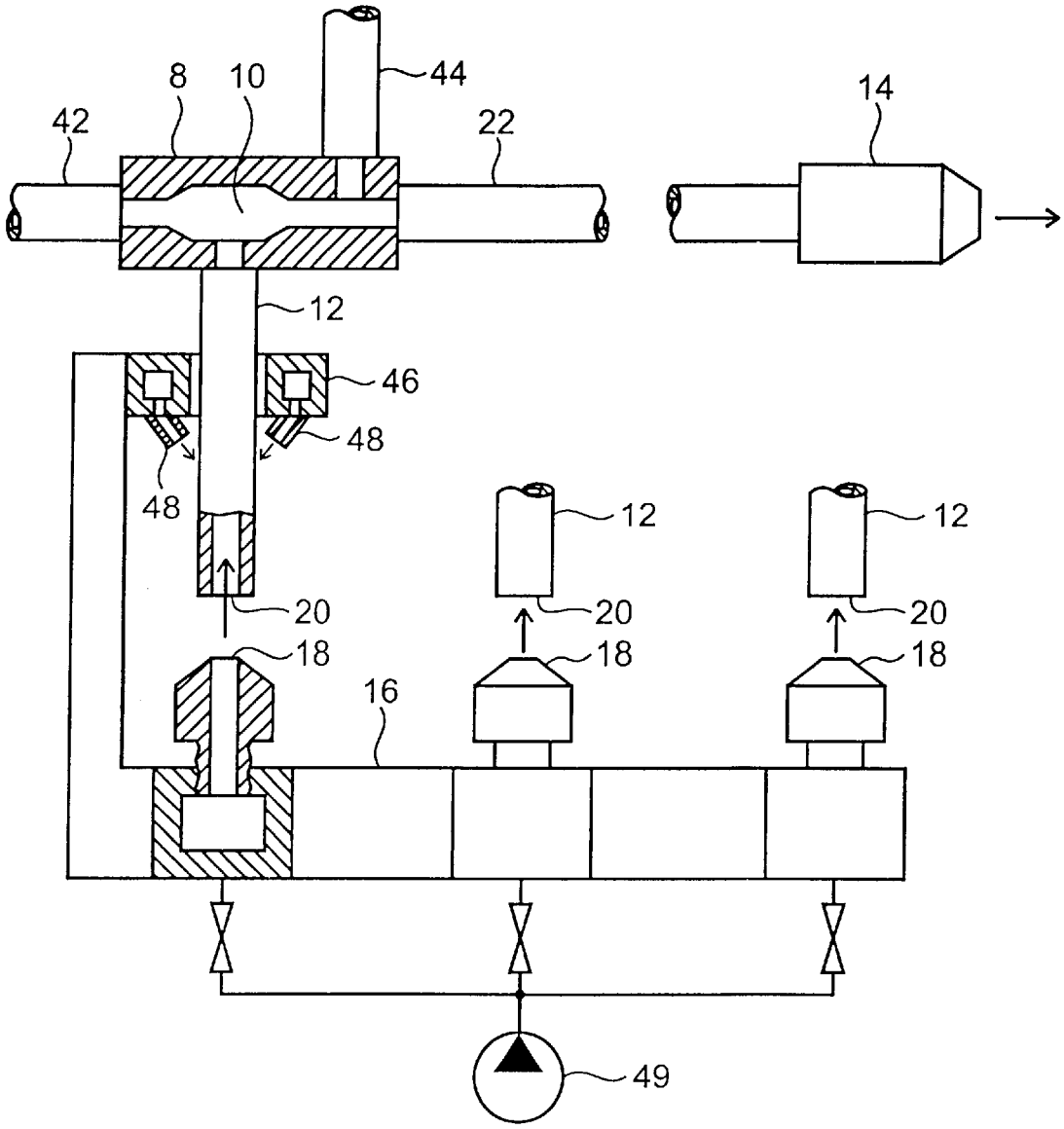
FIG. 2 is a sideview partly in vertical section of a cleaning unit of FIG. 1.

The spray-coating powder facility shown in FIGS. 1 and 2 illustratively contains three powder stations 2 each for one powder receptacle 4, further one injection unit 6 illustratively containing six injectors 8 each fitted with a powder pickup pipe 12 connected to its partial-vacuum zone 10. When the injection unit 6 has been lowered, the powder pickup pipes 12 will dip each into one of the powder containers 4 in order to aspirate powder from the receptacles 4 and to convey this powder pneumatically to a receiver which in this instance is a spray system 14.

A cleaning unit 16 comprises at least as many upward-pointing compressed-air outlets or compressed-air nozzles 18 as there are powder pickup pipes 12 in the injection unit 6. The injection nozzles 18 are arrayed in the same way, namely matching the downward-pointing intake apertures 20 of the powder pickup pipes 12 in order that, by lowering the injection unit 6, said powder intake apertures 20 can come to rest on the compressed-air nozzles 18, so that compressed cleaning air be blown through the powder pickup pipes 12, through their injectors 8 and through each connected powder hose 22, and again through the spray system 14, and in this manner to clean these parts after the powder pickup pipes 12 are lifted out of one powder receptacle 4 and before being dipped into another powder receptacle 4 from which they shall aspirate powder and feed it to the spray systems 14. For that purpose the injection unit 6 is driven by a displacement drive 24 (into displacement or position) in three dimensions, namely in the two horizontal dimensions x to and from one of the receptacles 4, in the y dimension parallel to the receptacles 2 arrayed in a straight line, preferably next to this line, to and from the cleaning unit 16 mounted next to said line, and in the vertical dimension z in order to alternatingly dip the powder pickup pipes 12 into one of the receptacles 4 or lowering them onto the cleaning unit 16.

The displacement drive 24 may be fitted for that purpose with an x-carriage 26 supporting the injection unit, with a y-carriage 28 supporting said x-carriage 26, and with guide rails 30*a* and 30*b* for said carriages and mounted parallel to the row of powder receptacles 4, for instance on a room floor or a room ceiling.

Except for the spray systems 14, all the above components are configured in an evacuation cabin 32, at least one blower 34—preceded at each blower by a filter 36—aspirating air and powder dust 38 out of said cabin 32 in order to preclude contamination by powder dust and powder particles inside said cabin and to generate in said cabin a slight partial vacuum preventing powder dust and powder particles passing from the cabin into the external environment. The filter and blower system 34, 36 aspirates air and powder dust 38*a*, 38*b* and 38*c* within the evacuation cabin 32 transversely to and through the powder stations 2 configured in a row in order to prevent cross flows between the powder receptacles 4 that might entail mixing different powder pigments. Preferably partitions 40 shall be set up between the powder receptacles 4 or powder stations 2.

One compressed-air conveyance line 42 is connected to each injector 8 and, in the partial-vacuum zone 10, aspirates powder through the powder pickup pipes 12 and conveys it pneumatically through the powder hose 22 to the spray system 14. The injector furthermore may be fitted with a supplemental-air adapter 44 to apply additional compressed air.

Figure 3:
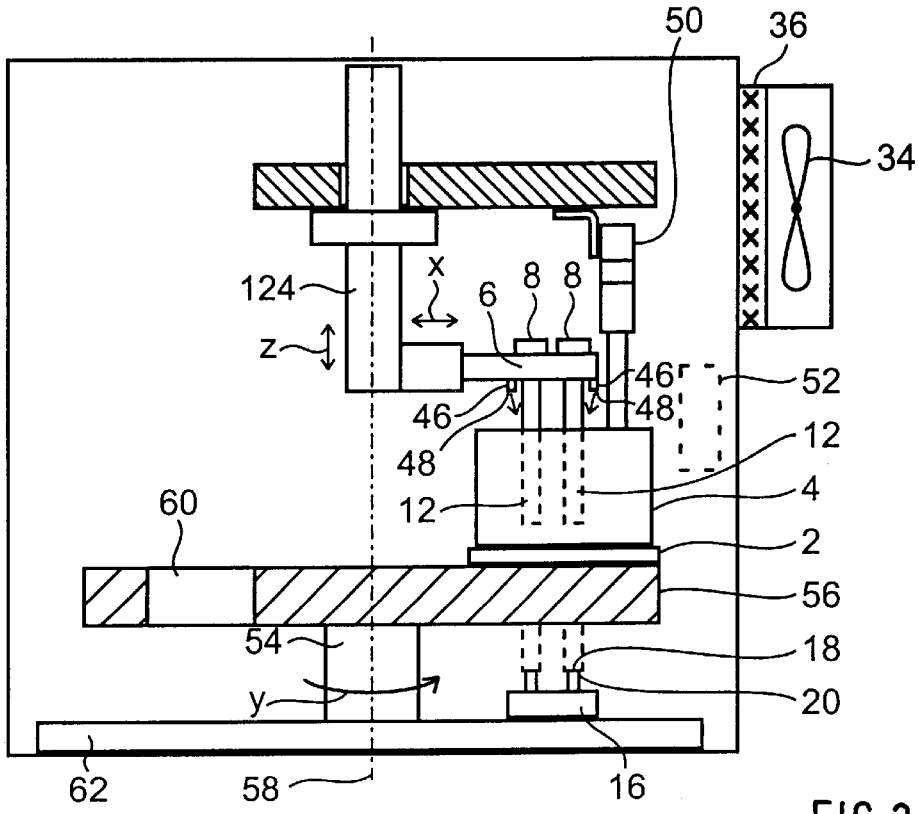
FIG. 3 is a schematic sideview of another embodiment of a spray-coating powder facility of the invention partly shown in a vertical section along the plane III—III of FIG. 4.

Preferably the invention also comprises a cleaning system 46 with which to clean external surfaces and it is fitted with at least one compressed air nozzle 48 through which the compressed cleaning air can be blown on the external surfaces of parts of the injection unit 6, at least on the external surfaces of the powder pickup pipes 12, when the injection unit 6 is in a position opposite the cleaning unit 16. The cleaning compressed-air nozzles 48 preferably are configured in such a way that while being lowered toward or lifted away from the cleaning unit 16, the powder pickup pipes 12 are moved past said nozzles 48 in such a way that they shall clean them over all their length. Preferably and as shown in FIG. 2, the external-surfaces cleaning system 46 is part of the cleaning unit 16, though it also may be mounted on the injection unit 6 as shown in FIG. 3 or to a part of the powder stations 2. FIG. 2 shows a compressed-air source 49.

The powder receptacles may be configured on a vibrator or be fitted with a vibrator and/or be supported on a weighing scale and/or be fitted with a fluidizing system to fluidize the powder they contain.

Coating powder can be automatically fed by means of a power feeding system 50 to the powder receptacles 2, preferably as a function of the powder level in the powder receptacle 2, as a result of which the powder level shall be kept substantially constant. The powder feed systems 50 may contain a sieve to sift the powder, a level detector to measure the powder level in the powder receptacle 4, and means allowing to recover sprayed powder.

As a function of predetermined operational conditions, preferably as a function of at least one computer program, an electronic control system 52 controls the relative motions of the minimum of one injection unit 6, the powder stations 2 and the minimum of one cleaning unit 16 and the external-surfaces cleaning system 46, further it controls powder conveyance through the injectors 8, powder changing (changing the injection unit 6 from one powder receptacle 4 to another powder receptacle 4 with interim cleaning at the cleaning unit 16), and the cleaning operation by means of the compressed cleaning air from the cleaning unit 16, and the external-surfaces cleaning system 46.

As regards the computer program, the control system 52 preferably shall be freely programmable in order that the powder facility can be quickly matched to client requirements and different operational conditions.

In a particular embodiment of the invention, the powder stations 2 together with the powder receptacles 4 are displaced in controlled manner in a horizontal x or y dimension of motion, the minimum of one injection unit 6 shall be displaceable in a vertical dimension of motion z, and the cleaning unit 16 is fixed in place in the horizontal dimension x and/or y of the powder stations. To these ends the powder stations 2 or their powder receptacles may be mounted on a stage which is displaced in controlled manner in either of the horizontal displacement dimensions x and/or y. The configuration shown in FIG. 1 applies to this case.

Figure 4:
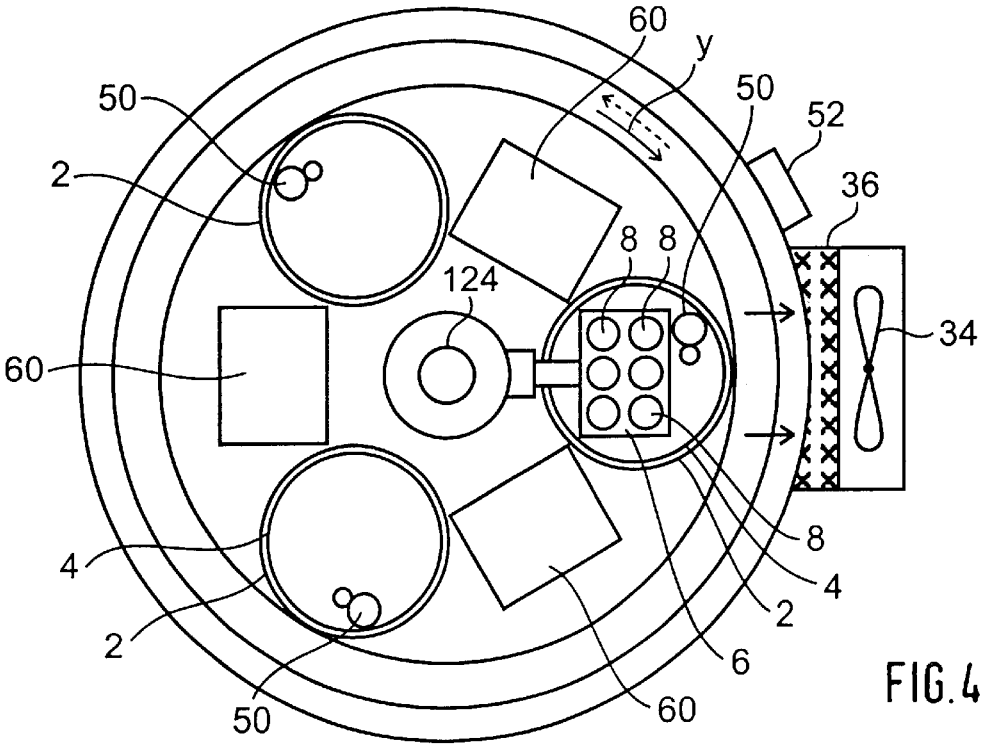
FIG. 4 is a topview of the powder facility of FIG. 3.

FIGS. 3 and 4 show an alternative, preferred embodiment for that purpose. The powder stations 2, i.e. their powder receptacles 4, are mounted in a circular line on a turntable 56 driven by a motor 54, the axis of rotation 58 of the turntable 56 being situated at the center of said circular line. The turntable 56 can be rotated stepwise always in the same direction, or, in another embodiment mode, it may be rotated forth and back in order to position another powder station 2 together with its powder receptacle 4 underneath the non-rotating injection unit 6. The drive system 124 does not drive the injection unit 6 in rotation, but only up and down, in order to alternatvely dip the powder pickup pipes 12 into one of the receptacles 4 to aspirate powder from them or to set the powder pickup pipes 12 through vertical passages 60 in the turntable 56 onto the compressed cleaning air nozzles 18 of the cleaning unit 16 that is mounted underneath the turntable 58 on a base 62.

As shown in FIG. 4, one such vertical passage 60 maybe constituted in the turntable 56 in every case between two powder stations 2 so that said passage is located on the same circle as are the powder stations 2. As a result, when changing pigments, only minute rotational forth-or-back steps are required in the y dimension of motion to position another powder station 2 together with its powder container 4 or one of the passages 60 between the cleaning unit 16 and the injection unit 6. The injection unit 6 need only be displaced by its drive system 124 in the vertical dimension of motion z. While motions of the injection unit 6 in the x dimension might be provided, they are not as a rule required in this embodiment. The cleaning unit 16 is not vertically displaceable nor is it configured for that purpose.

Furthermore the embodiment of FIGS. 3 and 4 exhibits the same features and functions as the embodiment of FIGS. 1 and 2 and corresponding parts are denoted by the same references.

What is claimed is:

1. A spray-coating powder facility, comprising:

at least two powder stations (2) each having one powder receptacle (4), at least one injection unit (6) including at least one injector (8) fitted with one powder pickup pipe (12) that can be dipped into said powder receptacles (4) to aspirate powder therefrom and to pneumatically convey the powder to a receiver (14), and at least one cleaning unit (16) fitted with at least one compressed-air outlet (18) matching an intake aperture (20) at a lower end of the powder pickup pipe (12) in order to blow compressed cleaning air through the powder pickup pipe (12) and through the associated injector (8) and to clean said pipe and said injector, wherein said at least one injection unit (6) is displaceable in controlled manner relative to the powder stations (2) and relative to said at least one cleaning unit (16) in order that said at least one injection unit (6) can be operationally connected alternatively to one of the powder stations (2) or to said at least one cleaning unit (16), and the powder pickup pipe (12) of said at least one injector (8) can alternatively be dipped into the receptacle (4) of one of the powder stations (2) in order to convey the powder out of said receptacle (4), or can be joined outside the receptacles (4) with the cleaning unit (16) in order to blow the compressed cleaning air through said at least one powder pickup pipe (12) and the associated injector (8).

2. The spray-coating powder facility as claimed in claim 1, wherein the powder stations (2) and said at least one cleaning unit (16) are mutually immobile; and said at least one injection unit (6) is displaceable relative to said powder stations and said at least one cleaning unit in controlled manner in at least two dimensions.

3. The spray-coating powder facility as claimed in claim 2, wherein the powder stations (2) are arrayed in a straight row or on a circular line.

4. The spray-coating powder facility as claimed in claim 3, wherein said at least one cleaning unit (16) is mounted beside the row or line of said powder stations (2).

5. The spray-coating powder facility as claimed in claim 1, wherein the powder stations (2) are displaceable in controlled manner in at least one horizontal direction of motion (y), said at least one injection unit (6) is displaceable in controlled manner in a vertical direction of motion (z), and said at least one cleaning unit (16) is mounted immobile in the horizontal direction of motion (y) of the powder stations (2).

6. The spray-coating powder facility as claimed in claim 5, wherein the powder stations (2) are mounted in a straight or circular line running in the horizontal direction of motion (y) on a stage (56) which is displaceable in controlled manner in the horizontal direction of motion.

7. A spray-coating powder facility, comprising a stage;

powder stations that are displaceable in controlled manner in at least one horizontal direction of motion;

at least one injection unit that is displaceable in controlled manner in a vertical direction of motion; and at least one cleaning unit that is mounted immobile in the horizontal direction of motion of the powder stations;

wherein the powder stations are mounted in a circular line running in the horizontal direction of motion on said stage which is displaceable in controlled manner in the horizontal direction of motion; and the stage is a turntable having an axis of rotation situated at the center of the circular line of said powder stations.

8. A spray-coating powder facility, comprising a stage;

powder stations that are displaceable in controlled manner in at least one horizontal direction of motion;

at least one injection unit that is displaceable in controlled manner in a vertical direction of motion; and at least one cleaning unit that is mounted immobile in the horizontal direction of motion of the powder stations;

wherein the powder stations are mounted in a straight or circular line running in the horizontal direction of motion on said stage which is displaceable in controlled manner in the horizontal direction of motion;

said at least one cleaning unit is mounted underneath the stage on a base; and the stage comprises at least one vertical passage extending through said stage, said passage allowing vertically joining said at least one injection unit and said at least one cleaning unit to carry out cleaning by means of compressed cleaning air.

9. The spray-coating powder facility as claimed in claim 1, further comprising an external surface cleaning system (46) which is fitted with at least one compressed-air nozzle (48) for blowing compressed cleaning air at least onto the external surfaces of the powder pickup pipe (12) when the injection unit (6) assumes a position opposite the cleaning unit (16).

10. The spray-coating powder facility as claimed in claim 1, wherein an itinerary of compressed cleaning air for the compressed cleaning air blown into the powder pickup pipe (12) beyond said pipe and the associated injector (8) runs as far as the receiver (14).

11. The spray-coating powder facility as claimed in claim 1, further comprising an electronic control system (52) containing at least one computer program adapted to control relative motions of said at least one injection unit (6), of the powder stations (2) and of said at least one cleaning unit (16), and to control powder conveyance, powder changing and compressed-air cleaning.

12. The spray-coating powder facility as claimed in claim 11, wherein the control system (52) is freely programmable as regards the computer program.

13. The spray-coating powder facility as claimed in claim 1, further comprising an evacuation cabin (32) in which at least the powder stations (2) and the cleaning unit (16) are positioned;

wherein said evacuation cabin (32) is fitted with a filter and blower system (34, 36) for filtering and evacuating air from the evacuation cabin into the external environment.

14. The spray-coating powder facility as claimed in claim 13, wherein the filter and blower system (34, 36) aspirates air in the evacuation cabin (32) transversely to and through the linearly arrayed powder stations (2).

15. Spray-coating powder equipment, comprising:

at least two powder stations each having one powder receptacle;

at least one injection unit including at least one injector having a powder pickup pipe moveable relative to said powder receptacles, wherein said powder pickup pipe has an intake aperture receivable in said powder receptacles to aspirate powder therefrom and to pneumatically convey the powder to a receiver; and at least one cleaning unit having at least one compressed-air outlet matching the intake aperture of the powder pickup pipe in order to blow compressed cleaning air through the powder pickup pipe and through the associated injector and to clean said pipe and said injector, wherein said at least one injection unit is displaceable in controlled manner relative to the powder stations and said at least one cleaning unit so as to be operationally connectable alternatively to one of the powder stations or to said at least one cleaning unit, so that the intake aperture of the powder pickup pipe of said at least one injector is either dipped into the receptacle of one of the powder stations in order to convey the powder out of said receptacle or joined with said at least one compressed-air outlet of the cleaning unit in order to blow the compressed cleaning air through said at least one powder pickup pipe and the associated injector; and the powder stations and said at least one compressed-air outlet of said at least one cleaning unit are mutually immobile.

16. The spray-coating powder equipment as claimed in claim 15, wherein the powder stations are arrayed in a straight row or on a circular line.

17. The spray-coating powder equipment as claimed in claim 16, wherein said at least one cleaning unit is mounted outside the row or line of said powder stations.

18. The spray-coating powder equipment as claimed in claim 15, wherein the powder stations are displaceable in controlled manner in at least a first direction of motion;

said at least one injection unit is displaceable in controlled manner in a second direction of motion different from the first direction of motion; and said at least one cleaning unit is mounted immobile in the first direction of motion.

19. The spray-coating powder equipment as claimed in claim 18, further comprising a stage on which the powder stations are mounted in a straight or circular line running in the first direction of motion, said stage being displaceable in controlled manner in said first direction of motion.

20. The spray-coating powder equipment as claimed in claim 18, wherein said powder stations are arranged in a circle and the stage is a turntable having an axis of rotation extending through the center of the circle.

* * * * *